US005933914A

United States Patent [19]

Beane

[11] Patent Number: 5,933,914

[45] Date of Patent: Aug. 10, 1999

[54] REPLACEABLE VACUUM CLEANER HOSE COVER AND BAG

[76] Inventor: Thomas F. Beane, 2674 Cool Springs Rd., Concord, N.C. 28025

[21] Appl. No.: 08/857,424

[22] Filed: May 16, 1997

[51] Int. Cl.[6] ..... A47L 9/24

[52] U.S. Cl. ..... 15/339; 15/246.2; 15/325; 138/110

[58] Field of Search ..... 15/325, 339, 246.2; 138/110

[56] References Cited

U.S. PATENT DOCUMENTS

| | | | |
|---|---|---|---|
| 4,697,300 | 10/1987 | Warlop | 15/339 X |
| 4,831,682 | 5/1989 | White | 15/325 X |
| 4,866,565 | 9/1989 | Wray | 15/339 X |
| 5,095,576 | 3/1992 | Galigan | 15/325 X |
| 5,150,499 | 9/1992 | Berfield | 15/339 X |
| 5,651,161 | 7/1997 | Asta | 15/339 X |

FOREIGN PATENT DOCUMENTS

| | | | |
|---|---|---|---|
| 233710 | 8/1987 | European Pat. Off. | 15/325 |

*Primary Examiner*—Chris K. Moore

[57] ABSTRACT

A replaceable vacuum cleaner hose cover made from a tube of circularly knitted yarn and a replaceable vacuum cleaner bag each having a ground yarn surface and terry loops extending from the ground yarn surface. The yarn used in forming the cover and bag is conventional multifilament crimped polyester or nylon yarn interspersed selectively with a carbon strand or strand segments, the strand effective for conducting electrostatic charges from the vacuum cleaner and vacuum cleaner hose to prevent electrostatic discharges that could occur from high electrostatic charge build up or inadvertent gas leakage within an environment and for eliminating algae and dust mites as a result of the electromagnetic field resulting from the use of this material.

40 Claims, 4 Drawing Sheets

REPLACEABLE VACUUM CLEANER HOSE COVER AND BAG

FIELD AND BACKGROUND OF THE INVENTION

1. Field of the Invention.

This invention relates to covers and bags for vacuum cleaner hoses and more particularly to a replaceable vacuum cleaner hose cover and bag formed from a tube of circularly knitted material including a synthetic yarn such as polyester or nylon in combination with one or more carbon strands.

2. Description of the Prior Art.

Numerous covers for vacuum cleaner hoses have been available over a long period of time to protect the basic hose and enhance its appearance. These covers have all been formed of woven material which is flat, cut to a specific size, and then seamed to form a tubular hose cover of a given diameter. The cover thus has a continuous seam extending throughout its longitudinal dimension. Vacuum cleaner bags have been formed in various shapes usually from woven or belt material.

The use of vacuum cleaners for cleaning within an ordinary household because of the apparatus itself and the contents of the household which includes other electrical apparatus such as television sets, kitchen appliances, furnaces and the like often cause a static build-up that periodically discharges, and startles and often shocks the user. In situations where air streams are involved to separate substances and create friction, electrostatic charges frequently occur or appear on the vacuum cleaner or on components of associated equipment being used. Under those circumstances, the electrostatic charge level can be such as to cause explosions which are capable of doing severe damage to the apparatus involved and, in certain circumstances, seriously injuring or even killing people employed in utilizing these appliances.

Electrostatic charges accumulate on the vacuum cleaner hoses, bags and other related accessories, and the dangers associated therewith are significant, particularly when dealing with central vacuum systems that enable the use of a central vacuum cleaner bag with a multiple array of vacuum cleaner hoses.

A previously unaddressed problem associated with vacuum cleaning is the presence of algae and dust mites, particularly prevalent in the household environment. These substances have life and grow and are very detrimental to the operation of a conventional vacuum system. They have a tendency to clog the filtering action of the vacuum cleaner bag, thereby resulting in ineffective cleaning and, more importantly, failure to remove those substances from the environment. No highly efficient effective means has, to date, been developed to eliminate or significantly reduce these problems.

While vacuum cleaner hose covers have been used over a considerable period of time for primarily tear resistant and aesthetic purposes, there is an even greater need to have a device of this nature that will prevent the damaging affect of electrostatic discharges that occur from high electrostatic charge build-up during vacuum cleaner use. The need is equally present with vacuum cleaner bags. It is to these needs that the present improvement is directed.

SUMMARY OF THE INVENTION

The present invention is a replaceable vacuum cleaner hose cover and bag for safely discharging electrostatic charges accumulating on the vacuum cleaner hose bag and related components during use which are formed from a tube of circularly knit material including synthetic multifilament, crimped yarn such as polyester or nylon and a carbon strand or strands, the strand or strands effective to conduct or dissipate electrostatic charges from the vacuum cleaner, vacuum cleaner hose and components. The circularly knitted material includes a ground yarn surface and terry loops extending from the ground yarn surface so that the terry loops provide a cushioning effect for the cover to resist area damage and hose snagging and the carbon strand prevents electrostatic discharges that could occur from high electrostatic build-up or in conjunction with inadvertent gas leakage within an environment such as a home. Similar fabric has been used in the industrial filter industry. See, for example, U.S. Pat. No. 4,322,232.

The formation of a knitted tubular member having a ground yarn surface and terry loops extending from the ground yarn surface is particularly appropriate in the hose cover since the terry loops provide a cushioning which prevents snagging and provides a fabric which will not run even if snagging should surprisingly occur. Such material can be washed and returned to use and can be formed of various materials to provide an aesthetic appearance. The cover can be made in varying diameters simply by selecting circular knitting machines of appropriate cylinder diameters and using compatible yarn tensions with respect thereto. The cover can be provided with various means to secure it to the vacuum cleaner hose at each end or at any other hose location.

The uses for the present invention are extensive including, for example, the hospital environment where electrostatic charge build-up and the presence of algae or dust mites can be intensive. Restaurants and cafeterias, schools, instrument intensive businesses, and various other well-known operations are ideal for the application of the present invention. Of course, the most likely, needed and economically well-received use would be in the home.

OBJECTIVES OF THE INVENTION

From the foregoing brief description of the invention, it will be apparent that a primary object of the present invention is to provide a vacuum cleaner hose cover and bag of the type described which will eliminate the likelihood of and ultimate damage from electrostatic build-up.

Another objective of the present invention is to provide a hose cover of the type described which, because of its knitted construction will prevent snagging as the hose is moved in an environment which causes it to engage sharp edges, furniture and other potentially damaging items.

Another objective of the present invention is to provide a hose cover of the type described which, because of its construction, will not run if snagging does occur.

Yet another further objective of the present invention is to provide a hose cover of the type described that can be washed and returned to use thus providing it with an extended use life.

Yet still another further objective of the present invention is to provide a hose cover of the type described which can be knitted in varying diameters which can include one or more carbon strands of varying size.

Still another further objective of the present invention is to provide a hose cover and bag of the type described which can be effective in illuminating algae and dust mites through the electromagnetic field resulting from the use of the particular material involved.

Still another additional objective of the present invention is to provide a vacuum cleaner bag of the type described which can add to the features and advantages offered by the vacuum cleaner hose cover because of the use of similar material in the formation thereof.

Thus, there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the arrangement of the components set forth in the following description or illustrated in the drawings. The invention is capable of other embodiments and of being practiced and carried out in various ways.

It is also to be understood that the phraseology and terminology employed herein are for the purpose of description and should not be regarded as limiting in any respect. Those skilled in the art will appreciate that the concept upon which this disclosure is based may readily be utilized as a basis for designing other structures, methods and systems for carrying out the several purposes of this development.

It is important that the claims be regarded as including such equivalent methods and products resulting therefrom that do not depart from the spirit and scope of the present invention. The application is neither intended to define the invention of the application, which is measured by its claims, nor to limit its scope in any way.

Thus, the objectives of the invention, previously set forth along with the various features of novelty which characterize the invention, are noted with particularity in the claims annexed to and forming a part of this disclosure. For a better understanding of the invention, its operating advantages and the specific results obtained by its use, reference should be made to the following detailed specification taken in conjunction with the accompanying drawings wherein like characters of reference designate like parts throughout the several views.

DETAILED DESCRIPTION OF THE PREFERRED EMBODIMENT

Figure 1:
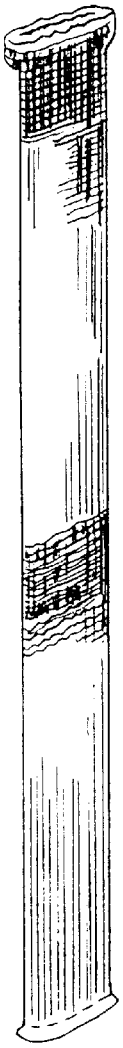
FIG. 1 is an elevational view of a vacuum cleaner hose cover embodying the present invention.
Figure 2:
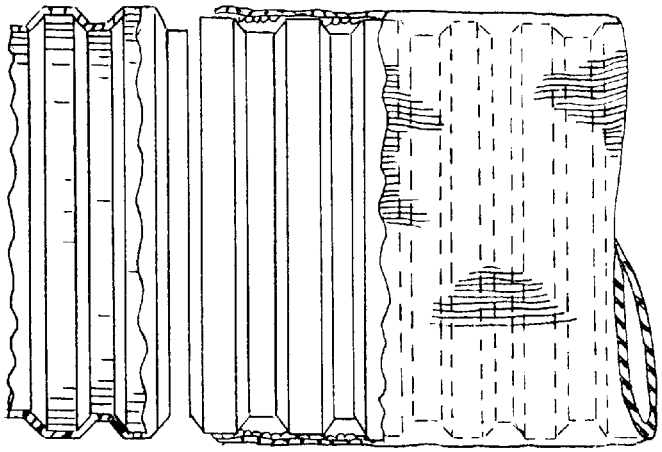
FIG. 2 is an elevational view, in section, showing the hose cover material of the present invention as installed about a vacuum cleaner hose.
Figure 3:
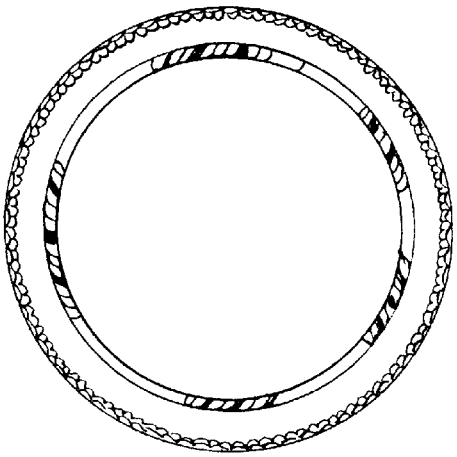
FIG. 3 is an elevational view, in section, showing the hose cover of the present invention installed about a vacuum cleaner hose.

Referring now more particularly to the accompanying drawings, a vacuum cleaner 10 utilizes a hose assembly 12 extending to an adaptable connector 14 suitable for utilizing a multitude of various components capable of cleaning in odd shaped and unusual areas as well as open unobstructed areas. The present invention comprises a vacuum cleaner hose cover shown generally as 16 which fits over hose 17 in the manner displayed best in FIG. 8. As various vacuum cleaners of different size and capacity utilize hoses of different sizes, the present invention can be modified to accommodate various hose sizes of diameters within the range of from ½ inch through 25 inches but more likely, the diameter will fall within the range of from 1 inch to 6 inches.

The vacuum cleaner hose cover and bag of the present invention includes a tube of circularly knitted materials containing conventional synthetic yarn 18 such as polyester or nylon, preferably multifilament, and a metallic strand or strands 20 such as carbon. The synthetic yarn is knit into stitches defining a ground yarn surface with terry loop pile extending from the ground yarn surface to a predetermined height and a carbon strand or strands preferably around 24 denier with 4 filaments preferably falling within the range of from 15 to 30 denier. Specific ranges for the denier of the synthetic yarn and the height of the terry loops may be determined by persons skilled in the appropriate arts. For example, the fabric may be formed with yarn of 100 denier knit into stitches defining terry loop pile extending approximately 2 millimeters from the ground yarn surface.

Figure 4:
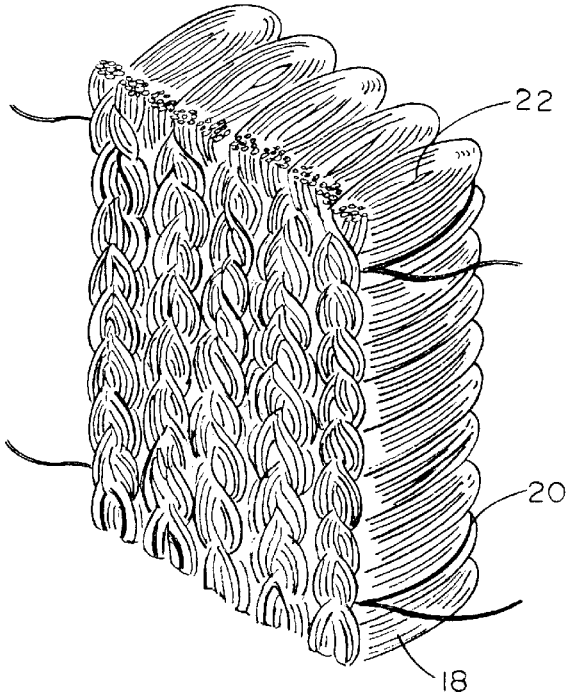
FIG. 4 is a perspective view, from a ground yarn surface side, of the fabric making up the hose cover and bag embodying the present invention.
Figure 5:
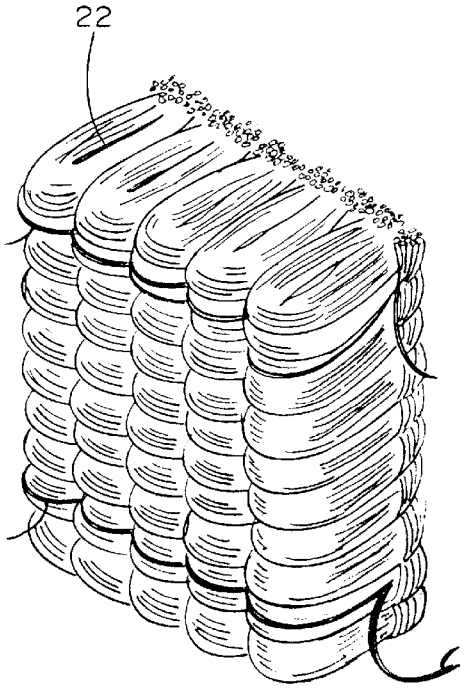
FIG. 5 is a view similar to FIG. 4, of the terry loop face of the fabric shown in FIG. 4.
Figure 6:
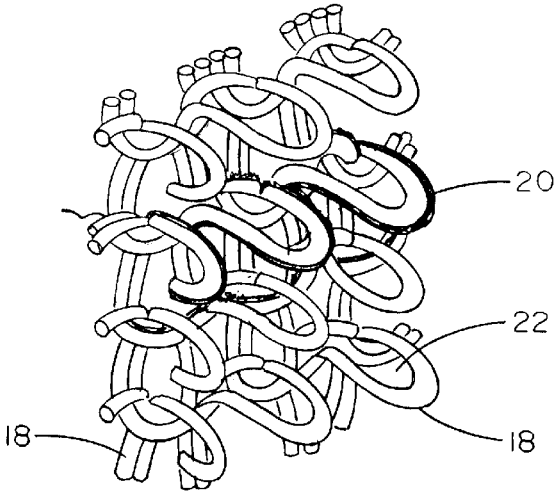
FIG. 6 is a schematic representation of the knit stitch structure of the fabric of FIGS. 4 and 5, particularly displaying the conductive carbon strand incorporated in the hose cover and in accordance with the present invention.
Figure 7:
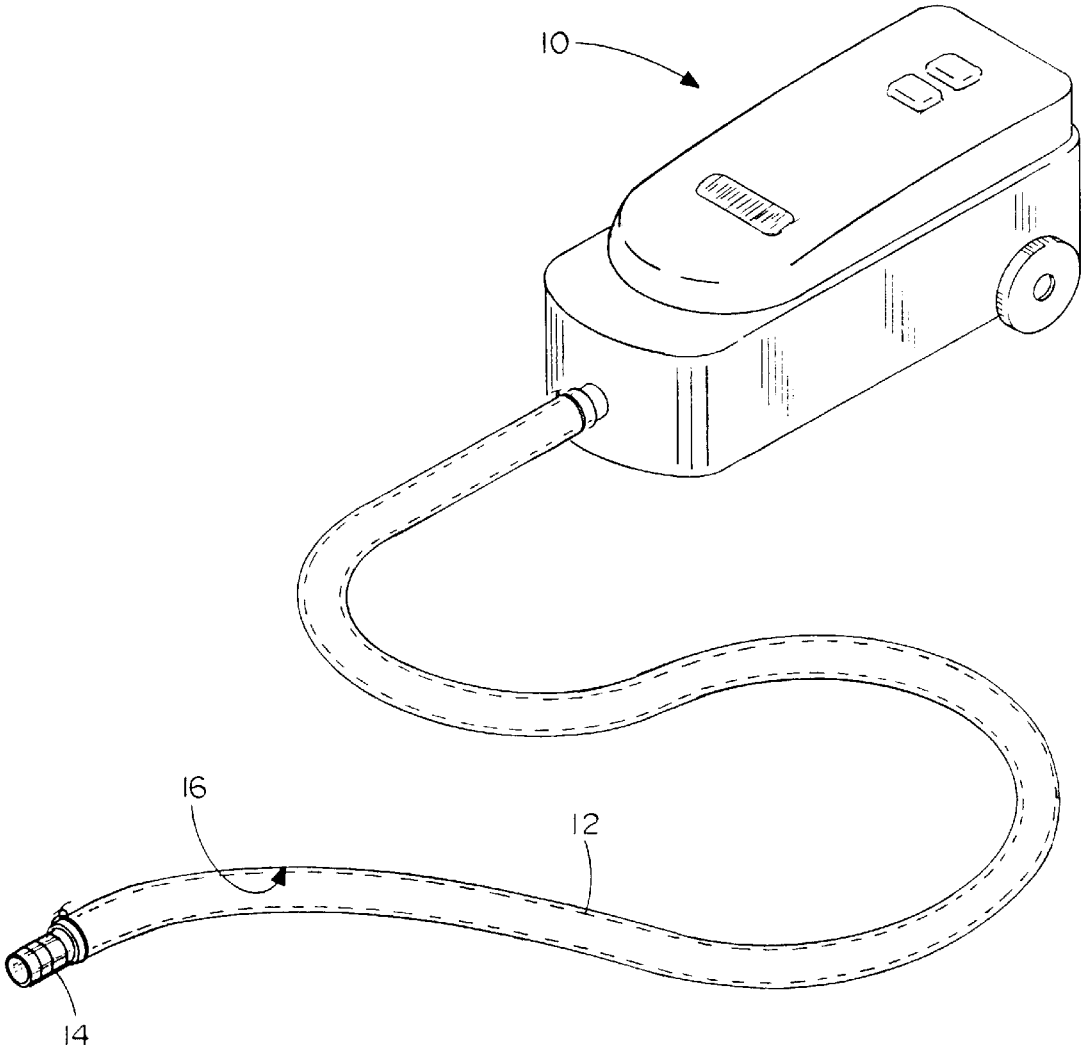
FIG. 7 is a perspective and sectional view of a vacuum cleaner utilizing the vacuum cleaner hose cover and bag embodying the present inventive concept.

The objectives of the present invention directed to minimizing electrostatic discharges that can occur from high electrostatic charge build-up are accomplished by including carbon strand 20 to conduct electrostatic charge build-up from vacuum cleaner 10 and vacuum cleaner hose assembly 12. More particularly, the hose cover including carbon strand 20 which is knitted with the synthetic yarn forming a ground yarn surface and terry loops is shown enlarged in FIGS. 4, 5 and 6. In the enlarged schematic representation of FIG. 6, the conductive strand is indicated by darker shading than the synthetic yarn. Similarly, in FIGS. 4 and 5, the conductive strand is knitted with a synthetic yarn forming pile or terry loops 22.

One operating embodiment of the present invention was constructed in accordance with the method in which a carbon strand 20 was knitted with the synthetic yarn 18 forming the fabric. The carbon strand was fed through a six feed knitting machine together with a synthetic yarn so as to form the strand and the yarn together in stitches defining the terry loop pile shown in FIGS. 4–6. The machine used in this embodiment had six feeds, and two yarns were fed into each feed, one feed including a synthetic yarn 18 along with carbon strand 20. Carbon strand 20 may be formed using relatively short lengths of metallic strands and will perform the conductive function required in accordance with the present invention.

The hose cover material providing a portion of the present invention is continuously knit so that the carbon strand 20 is uninterrupted throughout its length. Hose cover 16 is connected to hose 17 at its ends 24, 26 and, if desired, at other locations along its length so that when the complete installation is made, solid connection is made to ground in the apparatus to provide a dissipating location for the electrostatic charge build-up.

Figure 8:
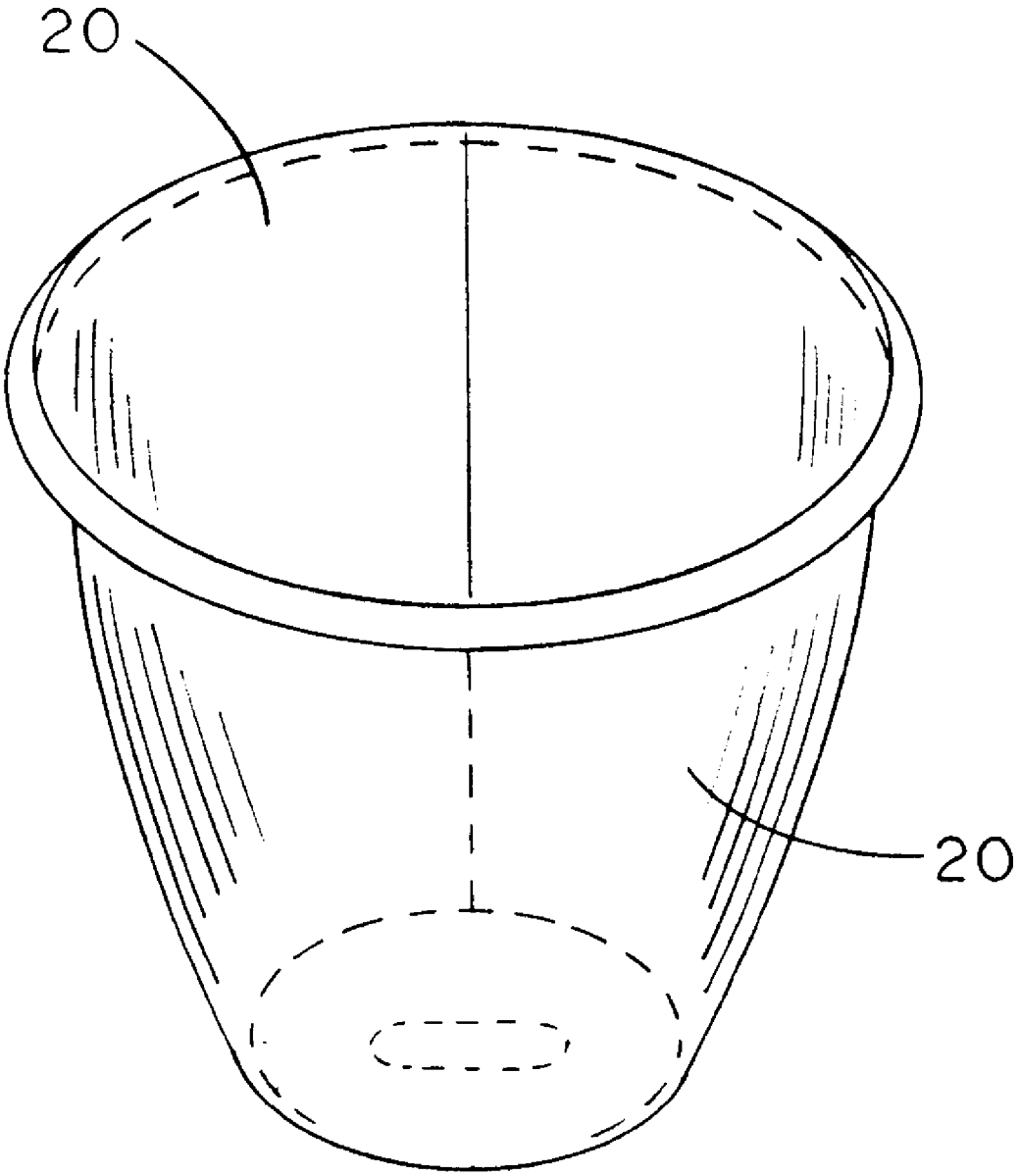
FIG. 8 is a perspective view of one form of a vacuum cleaner bag usable in combination with a vacuum cleaner and the vacuum cleaner hose cover comprising the present invention.

The fabric developed for the vacuum cleaner hose cover is equally applicable to the vacuum cleaner bag and supplements the dissipating action of the vacuum cleaner hose to reduce the risk of electrostatic build-up discharge from the use of the vacuum cleaner. The benefits received from the use of such fabric in the hose cover are equally provided by forming the vacuum cleaner bag of the same material including the carbon strand 20 (FIG. 8).

Of equal value in the present invention is the ability of the fabric used for the vacuum cleaner hose cover and the vacuum cleaner bag to eliminate algae and dust mites when used in environments that are particularly infused with such substances. Dust mites are disease carriers and reside in nearly every environment unless they are eliminated by chemical treatment. The present invention, through the use of carbon strands, creates an electromagnetic field which destroys such growth and effectively eliminates the build-up normally occurring on filters used in such environments.

Although one or more embodiments of the present invention have been shown and described, it will be obvious to those skilled in the art that the details of construction of these particular embodiments may be modified without departing from the concept presented. It is, therefore, intended that the invention be limited only by the scope of the appended claims rather than by particular details of construction shown.

What is claimed is:

1. A replaceable vacuum cleaner hose cover for discharging electrostatic charges accumulating on a vacuum cleaner and vacuum cleaner hose during use comprising: a tube of circularly knitted yarn having a ground yarn surface and terry loops extending from the ground yarn surface; a carbon strand knitted with the yarn and in the ground yarn surface and terry loops of the tube for conducting and dissipating electrostatic charges from the vacuum cleaner and vacuum cleaner hose, the terry loops providing a cushioning effect for the hose cover to resist area damage and hose snagging and the carbon strand preventing electrostatic discharges that could occur from high electrostatic charge build-up and inadvertent gas leakage within an environment.

2. The hose cover and as claimed in claim 1 further comprising means for securing the hose cover to the hose.

3. The hose cover as claimed in claim 2 wherein the hose cover is washable and reusable.

4. The hose cover as claimed in claim 3 wherein the hose cover is snag resistant.

5. The hose cover as claimed in claim 2 wherein the hose cover is snag resistant.

6. The hose cover as claimed in claim 2 wherein the hose cover has a diameter within the range of from 1" to 15".

7. The hose cover as claimed in claim 1 wherein the first and second hose cover ends have means to secure the hose cover to the hose.

8. The hose cover as claimed in claim 7 wherein the hose cover is washable and reusable.

9. The hose cover as claimed in claim 8 wherein the hose cover is snag resistant.

10. The hose cover as claimed in claim 9 wherein the hose cover has a diameter within the range of from 1" to 15".

11. The hose cover as claimed in claim 7 wherein the hose cover is snag resistant.

12. The hose cover as claimed in claim 7 wherein the hose cover has a diameter within the range of from 1" to 15".

13. The hose cover as claimed in claim 1 wherein the hose cover is washable and reusable.

14. The hose cover as claimed in claim 13 wherein the hose cover is snag resistant.

15. The hose cover as claimed in claim 14 wherein the hose cover has a diameter within the range of from 1" to 15".

16. The hose cover as claimed in claim 1 wherein the hose cover is snag resistant.

17. The hose cover as claimed in claim 4 wherein the hose cover has a diameter within the range of from 1" to 15".

18. The hose cover as claimed in claim 1 wherein the hose cover has a diameter within the range of from 1" to 15".

19. The hose cover as claimed in claim 1 wherein the carbon strand is within the range of from 15 denier to 30 denier.

20. The hose cover as claimed in claim 19 wherein the carbon strand contains from 2 to 12 filaments.

21. A replaceable vacuum cleaner hose cover and bag for discharging electrostatic charges accumulating on the vacuum cleaner, vacuum cleaner bag, and vacuum cleaner hose during use comprising: a tube of circularly knitted yarn having a ground yarn surface and terry loops extending from the ground yarn surface; a carbon strand knitted with the yarn and in the ground yarn surface and terry loops of the tube for conducting and dissipating electrostatic charges from the vacuum cleaner, bag, and vacuum cleaner hose; and a bag formed of knitted yarn having a ground yarn surface, terry loops extending from the ground yarn surface and terry loops of the bag for conducting and dissipating electrostatic charges, the terry loops providing a cushioning effect for the hose cover to resist area damage and hose snagging and the carbon strand preventing electrostatic discharges that could occur from high electrostatic buildup and inadvertent gas leakage within an environment.

22. The hose cover as claimed in claim 21 further comprising means for securing the hose cover to the hose.

23. The hose cover as claimed in claim 22 wherein the hose cover is washable and reusable.

24. The hose cover as claimed in claim 23 wherein the hose cover is snag resistant.

25. The hose cover as claimed in claim 24 wherein the hose cover has a diameter within the range of from 1" to 15".

26. The hose cover as claimed in claim 22 wherein the hose cover is snag resistant.

27. The hose cover as claimed in claim 22 wherein the hose cover has a diameter within the range of from 1" to 15".

28. The hose cover as claimed in claim 21 wherein the first and second hose cover ends have means to secure the hose cover to the hose.

29. The hose cover as claimed in claim 28 wherein the hose cover is washable and reusable.

30. The hose cover as claimed in claim 29 wherein the hose cover is snag resistant.

31. The hose cover as claimed in claim 30 wherein the hose cover has a diameter within the range of from 1" to 15".

32. The hose cover as claimed in claim 28 wherein the hose cover is snag resistant.

33. The hose cover as claimed in claim 32 wherein the carbon strand contains from 2 to 12 filaments.

34. The hose cover as claimed in claim 28 wherein the hose cover has a diameter within the range of from 1" to 15".

35. The hose cover as claimed in claim 21 wherein the hose cover is washable and reusable.

36. The hose cover as claimed in claim 35 wherein the hose cover is snag resistant.

37. The hose cover as claimed in claim 36 wherein the hose cover has a diameter within the range of from 1" to 15".

38. The hose cover as claimed in claim 21 wherein the hose cover is snag resistant.

39. The hose cover as claimed in claim 21 wherein the hose cover has a diameter within the range of from 1" to 15".

40. The hose cover as claimed in claim 21 wherein the carbon strand is within the range of from 15 denier to 30 denier.

* * * * *